United States Patent [19]

Bumbera

[11] Patent Number: 4,519,134

[45] Date of Patent: May 28, 1985

[54] FINGERNAIL CLIPPING DEVICE

[76] Inventor: John Bumbera, 4 Stanworth La., Allentown, N.J. 08501

[21] Appl. No.: 604,244

[22] Filed: Apr. 26, 1984

[51] Int. Cl.[3] ..... A45D 29/02

[52] U.S. Cl. ..... 30/28

[58] Field of Search ..... 30/28, 29; 132/76.2

[56] References Cited

U.S. PATENT DOCUMENTS

| | | | |
|---|---|---|---|
| 612,990 | 10/1898 | Kiefaber | 30/28 |
| 860,975 | 7/1907 | Havell | 30/28 |
| 1,081,896 | 12/1913 | Eckler | 30/28 |
| 2,179,435 | 11/1939 | Smith | 30/28 |
| 2,753,626 | 7/1956 | Bowers | 30/28 |
| 2,799,923 | 7/1957 | Senshu | 30/28 |
| 3,013,334 | 12/1961 | Bassett | 30/28 |
| 3,744,131 | 7/1973 | Manes | 30/28 |
| 4,341,015 | 7/1982 | Young | 30/28 |

FOREIGN PATENT DOCUMENTS

| | | | |
|---|---|---|---|
| 33368 | 10/1885 | Fed. Rep. of Germany | 30/28 |

*Primary Examiner*—Jimmy C. Peters

*Attorney, Agent, or Firm*—Sperry, Zoda & Kane

[57] ABSTRACT

A nail clipper is disclosed which includes an upper and lower frame movable with respect to one another to effect clipping and defining a central opening therebetween which is completely free of obstruction. A peripheral retainer extends about the cutting ends of the upper and lower frame members and urges them to close for cutting action by movement of an arm secured to the retainer and camming by abutment adjacent to the upper surface of the upper frame member in such a fashion as to accurately control clipping. This allows the central opening to remain completely free of any type of structure as utilized in the prior art such as rods, dowels, studs or clamping means.

13 Claims, 5 Drawing Figures

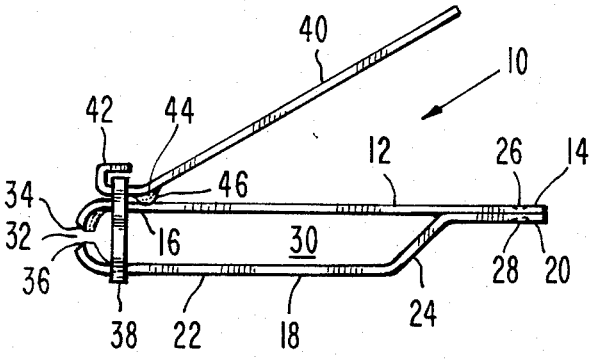
FIG. 1
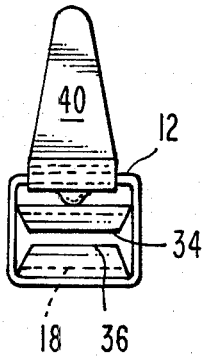
FIG. 2
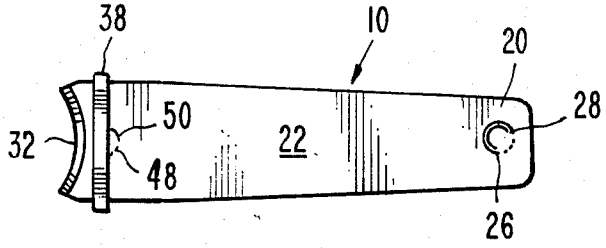
FIG. 3
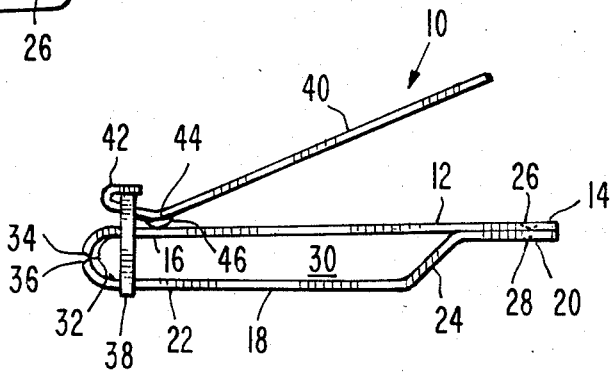
FIG. 4
FIG. 5
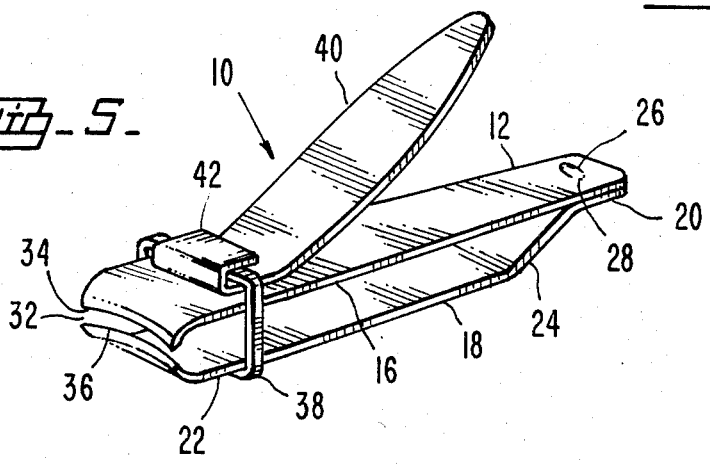

FINGERNAIL CLIPPING DEVICE

BACKGROUND OF THE INVENTION

1. Field Of The Invention

The present invention deals with the field of devices for clipping fingernails and toenails of human beings or animals. Such devices normally become excessively clogged with dirty nail clippings and are difficult to clean to remove this and other debris. The present invention provides a novel means for facilitating such cleaning.

2. Description Of The Prior Art

Many patents have been granted on nail clipper devices such as the following: U.S. Pat. Nos. 2,179,435; 2,467,589; 2,620,560; 2,753,626; 2,799,923; 2,829,433; 2,837,821; 3,180,025; 2,970,376; 2,995,820; 3,013,334; 3,031,753; 3,031,754; 3,154,850; 3,188,737; 3,744,131; 3,986,257; 4,219,929; and 4,341,015.

In most of these patents there is some structure positioned between the two movable clipping members for maintaining separation or achieving cutting movement of the blades. Also in most of these patents complicated designs are used with many moving parts. The present design overcomes these difficulties by its simple design. In the present invention there is no structure whatsoever between the two upper and lower movable members and thereby cleaning is greatly facilitated.

SUMMARY OF THE INVENTION

A fingernail clipping device is disclosed including an upper frame member which is generally horizontally flat and includes a first upper end and a second upper end. Similarly a lower frame member is defined with a first lower end and a second lower end. The lower frame member is secured with respect to the upper frame member at one location therealong normally somewhat adjacent to the first lower end means and the first upper end means thereof respectively.

Preferably the lower frame member will include an arcuate section adjacent to the first lower end means thereof such that the second lower end means will be at a position spatially disposed away from the upper frame member and specifically away from the second upper end means thereof. The lower frame means therefore will extend outwardly with respect to the upper frame member from this location of securement such that the second upper end means and the second lower end means will be somewhat near one another but will be spaced apart. Normally the first lower end means and the first upper end means will be in contact with respect to one another. In this manner the lower frame member and the upper frame member will define a central opening therebetween which will be open and free from any type of obstruction. Also the upper frame member and lower frame member will be movable with respect to one another normally by a resilience therein such that the second upper end means and the second lower end means can be moved from abutting contact to spatial separation selectively.

A cutting means is included in the structure which includes an upper cutting member fixedly secured and preferably integral with respect to the second upper end means of the upper frame means. Also a lower cutting member will be fixedly secured and preferably integral with respect to the second lower end means of the lower frame means. In this manner when the upper frame member and lower frame member are selectively moved toward one another cutting action will occur by contact of the upper cutting member with respect to the lower cutting member.

A peripheral retaining means preferably of rigid material will be positioned extending about the outer surface of the second upper end and the second lower end in such a manner as to control the total possible outward movement of them with respect to one another. This peripheral retaining means will extend across the top of the upper frame member and across the bottom of the lower frame member and opposite ends thereof will be secured with respect to one another by preferably an integral interlocking means.

To facilitate cutting action an arm means will be secured pivotally with respect to this peripheral retaining means or retainer. This arm will preferably include a hook means which itself is hooked about the portion of the peripheral retainer which extends across the upper surface of the upper frame member. Somewhat adjacent to the hook means a protrusion which operates as a cam will extend downwardly from the bottom surface of the arm in such a manner as to form an abutment surface in contact with the upper surface of the upper frame member. In this manner movement of the arm will cause downward movement of the cam and result in opposite upward movement of the peripheral retainer in such a fashion as to close the upper frame member and lower frame member with respect to one another and place the upper and lower cutting means in contact with one another for cutting action. Preferably the first upper end means and the second upper end means will be secured with respect to one another by a first securement means to assure that this securement is fixed and preferably this will be performed by a welding operation. Similarly a second securement means will preferably secure the bottom horizontally extending portion of the peripheral retainer with respect to the bottom surface of the lower frame member in such a fashion as to prevent separation thereof. This operation will also preferably be performed by welding.

It is an object of the present invention to provide a fingernail clipping device which is extremely sanitary in operation.

It is an object of the present invention to provide a fingernail clipping device which is easily cleaned.

It is an object of the present invention to provide a fingernail clipping device which is quick and efficient and accurate in operation.

It is an object of the present invention to provide a fingernail clipping device which includes no structural elements whatsoever between the clipping arms or upper and lower frame members.

It is an object of the present invention to provide a fingernail clipping device which has easy maintenance requirements and is simple in construction.

It is an object of the present invention to provide a fingernail clipping device which can be used with any type of fingernail gathering additional appliance.

It is an object of the present invention to provide a fingernail clipping device which does not accumulate dirty fingernail clippings or other debris.

It is an object of the present invention to provide a fingernail clipping device which is of minimal expense in manufacture.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a side plan view of an embodiment of the fingernail clipping device of the present invention;

FIG. 2 is a front plan view of the embodiment shown in FIG. 1;

FIG. 3 is a bottom view of an embodiment of the invention shown in FIG. 1;

FIG. 4 is a side plan view of the embodiment shown in FIG. 1 with the device in the clipping position; and FIG. 5 is a perspective view of the embodiment shown in FIG. 1.

DETAILED DESCRIPTION OF THE PREFERRED EMBODIMENT

The fingernail clipper 10 of the present invention includes an upper frame member 12 which extends generally horizontally and is secured with respect to a lower frame member 18 which extends therebelow. The upper frame member 12 includes a first upper end means 14 and a second upper end means 16. The general area of the first upper end means 14 is secured with respect to the lower frame member 18. The lower frame member 18 then generally extends outwardly therefrom away from the upper frame member such as to be spatially displaced therefrom. The lower frame member 18 includes a first lower end means 20 adjacent to the first upper end means 14 and a second lower end means 22 spatially distant from the second upper end means 16. Preferably the first upper end means 14 and the first lower end means 20 are secured with respect to one another such as by a first securement means 26 which may be a welding spot as shown in FIG. 1 as first weld means 28.

To facilitate the separation between the upper frame member 12 and the lower frame member 18 an arcuate section 24 is included in the central area of the lower frame member 18. This arcuate section separates the second lower end means 22 from the second upper end means 16 while allowing the first lower end means 20 to be adjacent to the first upper end means 14. In this manner the separated portions of the upper frame member 12 and the lower frame member 18 define a central opening 30 therebetween. This central opening is a novel aspect of the present invention since it is completely open and clear and includes no structural elements of the clipper therein whatsoever.

A cutting means 32 is generally defined adjacent to the second upper end means 16 and the second lower end means 22. The cutting means 32 includes an upper cutting member 34 fixedly secured with respect to the second upper end means 16 and preferably integral with respect thereto. Similarly a lower cutting member 36 is included with the cutting means 32 and is defined at the second lower end means 22 and preferably is integral with respect thereto. In this manner when the central opening 30 is collapsed by movement of the upper frame member 12 and the lower frame member 18 together with respect to one another the upper cutting member 34 and the lower cutting member 36 will contact one another and effect cutting operation.

Preferably the present invention will include a peripheral retaining means extending about the outer surface of the upper and lower frame member. This peripheral retaining means 38 generally is of a square configuration with the upper member positioned adjacent to the upper surface of upper frame member 12 and the lower portion positioned adjacent to the lower surface of lower frame member 18. To facilitate contact between the peripheral retaining means 38 and the lower frame member 18 a second securement means 48 is included. This may preferably take the form of a second weld means 50. In this manner the peripheral retaining means 38 restricts the movement of the upper frame member 12 and the lower frame member 18 with respect to one another. More specifically peripheral retaining means 38 restricts the movement of the upper cutting member 34 with respect to the lower cutting member 36 such that they are always adjacent with respect to one another but sometimes not in abutment. When placed in abutment they are in the cutting mode and when separated they are in the mode for receiving a fingernail.

To facilitate operation of the cutting means 32 an arm means 40 may be positioned adjacent to the upper surface of upper frame member 12. This arm means 40 includes preferably a hook-means 42 which extends about the horizontally extending upper portion of the peripheral retaining means 38 in such a manner as to be pivotally secured with respect thereto. A cam protrusion 44 extends downwardly from the bottom surface of the arm means 40 into abutting contact with the upper frame member 12. This cam protrusion 44 presents an abutment surface 46 in contact with the upper frame member 12.

In operation as the arm means 40 is pushed downwardly the clipper 10 of the present invention is moved in such a fashion as to cause cutting. More particularly the cam protrusion 44 urges the abutment surface 46 into contact with the upper portion of upper frame member 12 as the arm is moved further downwardly as shown best in the closed position shown in FIG. 4 the peripheral retaining means 38 pulls the lower frame member 18 upwardly and specifically pulls the second lower end means 22 thereof upwardly. In a similar but opposite fashion the abutment surface 46 urges the upper frame member and specifically the second upper end means 16 downwardly into contact with the second lower end means 22. The actual contact is made between the upper cutting member 34 and the lower cutting member 36 thereby effecting complete and efficient fingernail clipping.

The present invention is particularly novel in the ease of maintenance. That is the present invention can be easily cleaned with a brush or with pressurized air or in any way of a simple and efficient manner since there are no structural members whatsoever between the upper frame member 12 and the lower frame member 18. The entire inner portion of the central opening 30 is open and clear and therefore the present invention is usable with any type of nail gathering appliance.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A fingernail clipping device comprising:

(a) an upper frame member defining a first upper end means and a second upper end means;

(b) a lower frame member secured with respect to said upper frame member, said lower frame member including a first lower end means and a second lower end means, said first lower end means and said first upper end means being secured with respect to one another, said lower frame member extending outwardly with respect to said upper frame member from the location of securement with said second lower end means being spatially disposed adjacent said second upper end means, said upper frame member and said lower frame member being movable with respect to one another to selectively abut said second upper end means and said second lower end means, said lower frame member and said upper frame member defining a central opening therebetween;

(c) a cutting means comprising:

(1) an upper cutting member fixedly secured with respect to said second upper end means of said upper frame means; and (2) a lower cutting member fixedly secured with respect to said second lower end means of said lower frame means;

(d) a peripheral retaining means extending about the outer surfaces of said second upper end means and said second lower end means to restrict positioning of said said upper end means and said second lower end means to be adjacent and selectively spatially disposed with respect to one another; and (e) an arm means secured pivotally with respect to said peripheral retaining means adjacent to said upper frame member, said arm means including an abutment surface in contact with said upper frame member allowing movement of said upper cutting means into contact with said lower cutting means for fingernail cutting responsive to movement of the outer end of said arm means toward said upper frame member.

2. The device as defined in claim 1 further including a first securement means fixedly securing said first upper end means and said first lower end means with respect to one another.

3. The device as defined in claim 2 wherein said first securement means comprises a first weld means.

4. The device as defined in claim 1 wherein said peripheral retaining means is of a rigid material.

5. The device as defined in claim 1 wherein said arm means includes a cam protrusion upon which is located said abutment surface to facilitate movement of said upper and lower cutting means into contact with respect to one another.

6. The device as defined in claim 1 wherein said upper cutting means is integral with respect to said second upper end means.

7. The device as defined in claim 1 wherein said lower cutting means is integral with respect to said second lower end means.

8. The device as defined in claim 1 wherein said arm means includes a hook means which extends around said peripheral retaining means to allow pivotal movement with respect thereto.

9. The device as defined in claim 1 wherein said upper frame member is horizontally flat and wherein said lower frame member includes an arcuate section adjacent to said first lower end means to define said central opening.

10. The device as defined in claim 9 wherein said upper frame member and said lower frame member are of a flexibly resilient material to facilitate opening and closing of said cutting means.

11. The device as defined in claim 1 further including a second securement means securing said peripheral retaining means with respect to said lower frame means.

12. The device as defined in claim 11 wherein said second securement means comprises a second weld means.

13. A fingernail clipping device comprising:

(a) an upper frame member being horizontally flat and defining a first upper end means and a second upper end means, said upper frame member being of a flexibly resilient material;

(b) a lower frame member secured with respect to said upper frame member and being of a flexibly resilient material, said lower frame member including a first lower end means and a second lower end means, said first lower end means and said first upper end means being secured with respect to one another said lower frame member including an arcuate section extending outwardly with respect to said upper frame member from the location of securement with said second lower end means being spatially disposed adjacent said second upper end means, said upper frame member and said lower frame member being movable with respect to one another to selectively abut said second upper end means and said second lower end means, said lower frame member and said upper frame member defining a central opening therebetween;

(c) a cutting means comprising:

(1) an upper cutting member integral with respect to said second upper end means of said upper frame means; and (2) a lower cutting member integral with respect to said second lower end means of said second lower frame means;

(d) a pheripheral retaining means of rigid material extending about the outer surfaces of said second upper end means and said second lower end means to restrict positioning of said second upper end means and said second lower end means to be adjacent and selectively spatially disposed with respect to one another;

(e) an arm means including a hook means secured pivotally with respect to said peripheral retaining means adjacent to said upper frame member, said arm means including a cam protrusion which defines an abutment surface in contact with said upper frame member allowing movement of said upper cutting means into contact with said lower cutting means for fingernail cutting responsive to movement of the outer end of said arm means toward said upper frame member;

(f) a first securement means fixedly securing said first upper end means and said first lower end means with respect to one another, said first securement means comprising a weld means; and (g) a second securement means securing said peripheral retaining means with respect to said lower frame means, said second securement means comprising a second weld means.

* * * * *